US011654691B2

(12) United States Patent
Park

(10) Patent No.: US 11,654,691 B2
(45) Date of Patent: May 23, 2023

(54) INK STORAGE UNIT CAPABLE OF STIRRING INK BY INK CIRCULATION

(71) Applicant: GOSANTECH CO., LTD., Cheonan-si (KR)

(72) Inventor: Sohyeon Park, Cheonan-si (KR)

(73) Assignee: GOSANTECH CO., LTD., Cheonan-si (KR)

( * ) Notice: Subject to any disclaimer, the term of this patent is extended or adjusted under 35 U.S.C. 154(b) by 22 days.

(21) Appl. No.: 17/457,087

(22) Filed: Dec. 1, 2021

(65) Prior Publication Data

US 2022/0258489 A1 Aug. 18, 2022

(30) Foreign Application Priority Data

Feb. 18, 2021 (KR) ..... 10-2021-0022168

(51) Int. Cl.
*B41J 2/18* (2006.01)

(52) U.S. Cl.
CPC ..... *B41J 2/18* (2013.01)

(58) Field of Classification Search
CPC . B41J 2/18; B41J 2/17553; B41J 2/175; B41J 2/17596; B41J 2/20
See application file for complete search history.

(56) References Cited

U.S. PATENT DOCUMENTS 8,177,344 B2 * 5/2012 Asada ..... B41J 2/175 347/85
8,398,190 B2 * 3/2013 Kumagai ..... B41J 2/18 347/86
11,135,853 B1 * 10/2021 Yu ..... B41J 2/18

FOREIGN PATENT DOCUMENTS

| | | | |
|---|---|---|---|
| JP | 11-245429 | A | 9/1999 |
| JP | 2012-016823 | A | 1/2012 |
| KR | 10-2006-0135163 | A | 12/2006 |
| KR | 10-1191597 | B1 | 10/2012 |
| KR | 10-2012-0126551 | A | 11/2012 |
| KR | 10-2016-0007124 | A | 1/2016 |
| KR | 10-2016-0035004 | A | 3/2016 |
| KR | 10-2016-0117249 | A | 10/2016 |
| KR | 10-1989375 | B1 | 6/2019 |
| KR | 10-2019-0079823 | A | 7/2019 |
| KR | 10-2020-0005584 | A | 1/2020 |
| KR | 10-2097587 | B1 | 4/2020 |
| KR | 10-2020-0070676 | A | 6/2020 |

* cited by examiner

*Primary Examiner* — An H Do
(74) *Attorney, Agent, or Firm* — Sughrue Mion, PLLC

(57) ABSTRACT

An ink storage unit capable of stirring ink by ink circulation is proposed. The ink storage unit, which is configured to store ink for supplying the ink to an inkjet head including a plurality of nozzles to discharge the ink, includes an ink storage container having an inside space configured to store the ink therein, a head supply tube configured to supply the ink stored in the ink storage container to the inkjet head, a head recovery tube configured to recover remaining ink remained in the inkjet head to the ink storage container, a circulation tube configured to drain the ink through a first end thereof connected to the ink storage container and to receive the ink through a second end thereof connected to the ink storage container, and a circulation pump provided in the circulation tube to transfer the ink.

8 Claims, 9 Drawing Sheets

INK STORAGE UNIT CAPABLE OF STIRRING INK BY INK CIRCULATION

CROSS REFERENCE TO RELATED APPLICATION

The present application claims priority to Korean Patent Application No. 10-2021-0022168, filed Feb. 18, 2021, the entire contents of which is incorporated herein for all purposes by this reference.

BACKGROUND OF THE INVENTION

Field of the Invention

The present disclosure relates to an ink storage unit configured to store ink for supplying the ink to an inkjet head in an inkjet printer and, more particularly, to an ink storage unit applied to an inkjet printer used in the industrial field.

The present disclosure is a task performed with support from 2020 TIPS start-up commercialized start-up business of the Korea Institute of Startup & Entrepreneurship Development with financial resources of the Ministry of SMEs and Startups (No. 10346894).

Description of the Related Art

In general, an inkjet method of spraying liquid ink on a surface of a medium in a form of droplets according to a shape signal is used not only as printing for creating documents or flyers, but also in solution processes in semiconductor or display fields.

Inkjet printing, which can form a pattern of a complex shape on a substrate or precisely eject ink only at a specific location, has been expanding. A small inkjet printer for document writing is configured to store ink in an inkjet head that ejects ink droplets, but a large inkjet printer for document writing or an inkjet printer manufactured for industry uses a large amount of ink, and has a separate structure in which an ink storage unit that stores ink and the inkjet head are separated.

In order to eject a correct amount of ink in the inkjet printing process, the ink in the ready state for ejection from the inkjet head must maintain a meniscus state, which is a curved state in which a surface of a the ink is curved inward by capillary action based on a nozzle inlet. For achieving the meniscus state, in general, as the ink storage unit is located higher than the inkjet head and negative pressure is generated inside an ink storage tank, it is possible to prevent the ink from flowing down from the inkjet head to maintain the meniscus state.

In the traditional printing field, inkjet printing was performed using ink containing color pigments. Since the ink is stored for a long time in the ink storage unit separated from the inkjet head or in a cartridge coupled to the inkjet head until printing is performed, a surfactant was used together as a dispersant to maintain the dispersibility of color pigments.

Recently, the characteristic of the inkjet printer that can precisely eject a certain amount of ink is applied to the manufacturing process of products. In particular, the application of the inkjet printer to manufacture of electronic products that require high precision is increasing. Industrial inkjet printers used for product manufacture use ink together with color pigments or ink containing materials necessary for manufacturing substances instead of pigments. For example, when an insulating coating is performed on a part of an electric/electronic component, a polymer resin, as an insulating material, is used together with pigments, and an ink containing metallic copper is used to form a metal conductor. In addition, ink for inkjet printing used in the industrial field includes various components. Therefore, it is difficult to maintain the dispersibility of various substances included in the ink simply by adding the dispersant together. It often happens that the homogeneity of ink is broken while the ink is stored in the ink storage unit or ink cartridge.

Recently, as the inkjet printer is applied to ultra-precision fields such as semi-finishing manufacturing processes, a demand for precision in printing is increasing. Therefore, as a material included in the ink, materials that are difficult to maintain the dispersibility such as quantum dot materials, which is used in light emitting units or color filters in the display field, as well as metal particles for electrode patterns are used. Moreover, efforts to inkjet printing of inks including various materials, such as the development of a technology for coating PZT with inkjet printing, are being carried out in various ways. Even when the ink does not contain particle-like substances, various kinds of substances are used in the ink used for industrial inkjet printing, so it is an important issue to maintain the uniformity of the ink.

A technique has been developed to maintain the dispersibility of ink by returning the ink of the inkjet head to the ink storage unit and circulating the ink without supplying the ink in one direction toward the inkjet head. However, maintaining the dispersibility of ink stored in the ink storage unit is still an important issue. In addition, a stirring technique for maintaining the homogeneity of the ink even while the ink is stored in the ink storage unit is required.

Therefore, in order to apply the inkjet printing to the industrial field, a technique for maintaining the dispersibility of a material, which has low dispersibility in ink such as nanorods, is required.

DOCUMENTS OF RELATED ART (Patent Document 1) Korean Patent Application Publication No. 10-2016-0117249;
(Patent Document 2) Korean Patent Application Publication No. 10-2016-0007124;
(Patent Document 3) Korean Patent Application Publication No. 10-2016-0035004;
(Patent Document 4) Korean Patent Application Publication No. 10-2006-0135163;
(Patent Document 5) Korean Patent No. 10-2097587;
(Patent Document 6) Korean Patent Application Publication No. 10-2020-0005584;
(Patent Document 7) Korean Patent No. 10-1989375; and
(Patent Document 8) Japanese Patent Application Publication No. 2012-016823.

SUMMARY OF THE INVENTION

Accordingly, the present disclosure has been made keeping in mind the above problem occurring in the related art, and the present disclosure is intended to provide an ink storage unit configured to stir ink without a stirrer installed in an ink storage space and to maintain the desired dispersibility of the ink.

In order to achieve the above objective, according to one aspect of the present disclosure, there is provided an ink storage unit capable of stirring ink by ink circulation, the ink storage unit being configured to store ink for supplying the ink to an inkjet head including a plurality of nozzles to discharge the ink, the ink storage unit including: an ink storage container having an inside space configured to store the ink therein; a head supply tube configured to supply the ink stored in the ink storage container to the inkjet head; a head recovery tube configured to recover remaining ink remained in the inkjet head to the ink storage container; a circulation tube configured to drain the ink through a first end thereof connected to the ink storage container and to receive the ink through a second end thereof connected to the ink storage container; and a circulation pump provided in the circulation tube to transfer the ink, wherein the ink stored in the ink storage container may be stirred by a flow of the ink re-injected to the ink storage container through the circulation tube.

When a conventional bar-type stirring device, which that rotates about a vertical axis of rotation that does not obtain sufficient effect even for ink in which quantum dot material is dispersed, uses ink containing nanorods that are larger in size than the quantum dot materials, it is more difficult to maintain the dispersibility of the ink. Accordingly, the applicant of the present disclosure has developed and applied for a technique for the ink storage unit including a stirring device that stirs ink located at the bottom among the inks stored in the ink storage unit in a manner in which ink is raised upward, but the applicable shape of the ink storage unit is limited. In the case of an industrial inkjet print used in manufacture of a recent display device, etc., the width of the space for installing the ink storage unit is narrow, so the ink storage unit must be configured such that the height (length in the vertical direction) is long and the shape of the ink storage unit is limited, thus the stirring device of the prior application is difficultly installed. Moreover, since the shape of the ink stored in the ink storage unit has a narrow width and a long height, the dispersion degree of particles is increased depending on the location in the stored ink.

According to the present disclosure, without the stirrer, the dispersibility of particles contained in ink is maintained by self-circulation of ink stored in the ink storage unit, the shape of the ink storage unit is not limited for installation of the stirrer, and the present disclosure may be applied to the ink storage unit in the shape of the narrow width and long height.

Moreover, when the stirrer is applied to the ink storage unit, in order to transmit a force to rotate the stirrer, the shape of the stirrer was limited or a special structure was needed for power transmission, and the structure for power transmission is configured to be complex in order to avoid damaging the airtight structure of the ink storage unit, but the present disclosure does not have this problem in aspect excluding the stirrer.

An inlet configured to re-inject the ink from the circulation tube to the ink storage container may be located more than a predetermined height from a bottom of the ink storage container, and the ink stored in the ink storage container may be stirred by a downward flow of ink generated by the ink injected from the inlet.

The head recovery tube may be connected to the bottom of the ink storage container, and the ink injected through the recovery port located at an end of the head recovery tube may generate an upward flow of ink to stir the ink stored in the ink storage container.

An ink replenishing tube may be connected to the bottom of the ink storage container, and the ink stored in the ink storage container may be stirred by an upward flow of ink generated by the ink injected through a replenishing port located at an end of the ink replenishing tube.

The ink storage container may have a shape with a cylindrical side wall and an inverted conical bottom, the bottom of the ink storage container being concentrically narrowed in a downward direction.

The head recovery tube may be connected to the bottom of the ink storage container, and the ink stored in the ink storage container may be stirred by a flow of spiral rising ink generated as the ink injected through a recovery port located at an end of the head recovery tube is injected toward the bottom.

A drain tube may be connected to the ink replenishing tube to empty the inside of the ink storage container.

A degasser may be provided in the circulation tube to remove micro bubbles and gas dissolved in the ink.

The circulation tube may include a filter to remove micro bubbles and impurities.

A partition wall having a through hole may be provided in the ink storage container. The through hole may be formed in a circular shape of or a vertically or horizontally long slit.

According to the present disclosure as described above, the ink storage unit is configured to circulate ink stored in the ink storage container and re-inject the circulated ink to generate a flow for stirring. Therefore, even when a stirrer is not installed in the ink storage container, the ink storage unit can maintain the desired dispersibility by sufficiently stirring the ink.

Furthermore, the ink storage unit is configured to generate a downward flow of ink through the circulation tube, and to strengthen the upward flow by the head recovery tube and the ink replenishing tube. Therefore, the ink storage unit can circulate upper ink and lower ink to each other to stir the ink.

Moreover, the ink storage unit is configured to generate a spiral flow by injecting ink, which is recovered through the head recovery tube in the bottom having a shape gradually narrower toward the center and toward the bottom. Therefore, the ink in the ink storage container can be rotated and stirred.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE INVENTION

Figure 1:
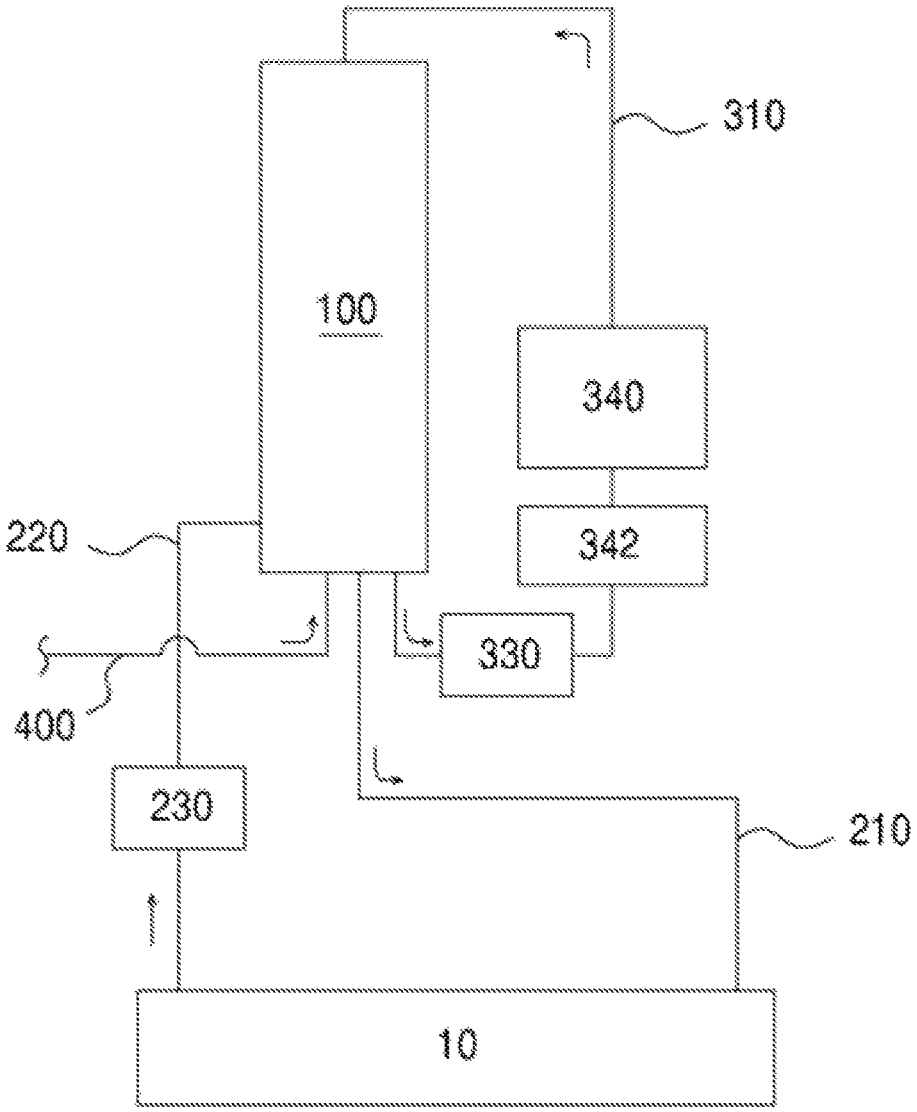
FIG. 1 is a schematic diagram showing a structure of an ink storage unit capable of stirring ink by ink circulation according to a first embodiment of the present disclosure.

Embodiments of the present disclosure will be described in detail with reference to accompanying drawings.

It should be understood that the embodiments of the present disclosure may be changed to a variety of embodiments and the scope and spirit of the present disclosure are not limited to the embodiments described hereinbelow. It should be understood that the shape and size of components shown in the drawings may be exaggeratedly drawn to provide an easily understood description of the structure of the present disclosure.

It will be understood that when an element is referred to as being "coupled" or "connected" to another element, it can be directly coupled or connected to the other component or it can be electrically connected to the other components with an intervening device therebetween. It will be further understood that the terms "comprise", "include", "have", etc. when used in this specification, specify the presence of stated features, integers, steps, operations, elements, components, and/or combinations of them but do not preclude the presence or addition of one or more other features, integers, steps, operations, elements, components, and/or combinations thereof.

Terms such as 'a first ~' and 'a second ~' are used only for the purpose for distinguishing a constitutive element from other constitutive elements, but the constitutive element should not be limited to a manufacturing order, and the terms described in the detailed description of the invention may not be consistent with those described in the claims. A first component discussed below could be termed a second component without departing from the teachings of the present disclosure. Similarly, the second component could also be termed the first component.

FIG. 1 is a schematic diagram showing a structure of an ink storage unit capable of stirring ink by ink circulation according to a first embodiment of the present disclosure.

According to the embodiment of the present disclosure, the ink storage unit of the inkjet printer includes an ink storage container 100, a head supply tube 210, a head recovery tube 220, a head circulation pump 230, a circulation tube 310, a circulation pump 330, and an ink replenishing tube 400.

The ink storage container 100 is configured to store ink therein. The ink storage container 100 may be connected to a plurality of tubes for introducing and draining the ink thereinto and therefrom and each tube may be formed of various materials. The shape of the ink storage container 100 is not particularly limited, but the ink storage container 100 of the present disclosure is suitable for a shape of an ink storage space with narrow width and long height. The storage space with narrow width and long height has a structure in which dispersibility of particles contained in ink is significantly increased between an upper portion and a lower portion of the storage space. In this structure, there is a serious problem in which it is difficult to install a stirrer for circulating ink in the upper portion and ink in the lower portion. The ink storage container 100 of the present disclosure has an effect of maintaining the dispersibility of particles in ink by self-circulation of the ink stored in the storage space with the structure with a narrow width and long height for installation of the stirrer to be difficult. Preferably, when the ink storage space is formed in a cylindrical shape, mixing efficiency due to a flow of ink stored in the storage space is improved. Furthermore, when the stirrer is used to stir the stored ink, an area where the ink does not move and stagnates is generated due to the nature of the stirrer effect not reaching the entire storage unit, and a particle settling problem occurs in the area where the ink stagnates. As the ink storage unit of the present disclosure is configured to allow the stored ink to be flow, the stored ink may be entirely stirred. Moreover, the ink storage unit of the present disclosure is configured to prevent stagnation of the ink by a shape of a bottom, which will be described below.

As not shown in the accompanying drawings, in order to maintain the meniscus state of the ink in an inkjet head 10, the ink storage unit of the present disclosure is connected to a pressure controller, which controls inner pressure of the ink storage container 100, to apply negative pressure into a the ink storage container 100. In order to perform pressure control by the pressure controller, the ink storage container 100 should maintain airtightness except for various tubes provided to allow the ink to move. The various tubes connected to the ink storage container 100 is in a blocked state except when the ink is filled in the tubes or moves, so that the airtightness of the ink storage container 100 may be maintained. When the stirrer is installed in the ink storage container 100, it is difficult to maintain the airtightness of the ink storage container, or a power transfer structure of the stirrer should be complex in order to maintain the airtightness. However, since the ink storage unit of the present disclosure does not use the stirrer, there is not a problem that the structure thereof is complex or a manufacturing cost thereof is increased for maintaining the airtightness of the ink storage container.

The head supply tube 210 connected to the ink storage container 100 is a route for supplying the ink stored in the ink storage container 100 to the inkjet head 10. The head recovery tube 220 is a route provided to recover ink remaining in the ink supplied to the inkjet head 10 to the ink storage container 100. The head circulation pump 230 provided to transfer the ink is installed on a head circulation line including the head supply tube 210 provided to supply and recover the ink with respect to the inkjet head 10 and the head recovery tube 220. The head circulation pump 230 may be selectively installed on one of the head supply tube 210 and the head recovery tube 220 or at both the head supply tube 210 and the head recovery tube 220. In FIG. 1, the head circulation pump 230 is installed on the head recovery tube 220. As the head circulation pump 230, all types of pumps capable of circulating ink within a range without affecting a characteristic of the present disclosure may be applied to the ink storage unit of the present disclosure. For example, the pump module of the present disclosure may consist of a pump including an impeller or a plurality of piezoelectric pumps, or the plurality of piezoelectric pumps are connected to each other in series or parallel and then the plurality of piezoelectric pumps is selectively operated so that series connected driving, parallel connected driving, and series and parallel connected driving of the pump module may be controlled.

A continuous flow of the ink is caused by repeatedly performing circulation of the ink such that the ink stored in the ink storage container 100 is supplied to the inkjet head 10 through the head supply tube 210 and the remaining ink is recovered to the ink storage container 100 through the head recovery tube 220, so that the dispersibility of the ink may be increased. However, the amount of circulated ink through the head circulation line connected to the inkjet head 10 that discharges a precisely adjusted amount of ink needs to be limited within a predetermined range. It is difficult to maintain the dispersibility with respect to the ink containing nanorods having a lower dispersion retentivity than quantum dot materials only with the circulation of ink through the head circulation line. Therefore, a new method that can improve the dispersibility by a flow of ink through the head circulation line is applied to the present disclosure, and the new structure will be described in detail later. The storage space in the ink storage container 100 includes a supply port and a recovery port respectively connected to the head supply tube 210 and the head recovery tube 220. The head supply port is provided at a bottom of the ink storage space or a location close to the bottom. Although the location of the recovery port is not particularly limited, the ink storage unit of the present disclosure is configured to check the location of the recovery port for increasing stirring efficiency of the ink, and the structure thereof will be described in detail.

The circulation tube 310 is connected to the ink storage container 100. The circulation tube 310 is a circulation line configured to drain the ink stored in the ink storage container 100 to the outside and to inject the ink into the ink storage container 100 again. The circulation pump 330 for transferring the ink is installed on the circulation tube 310. As the circulation pump 330, all types of pumps capable of circulating ink within a range not affecting the characteristic of the present disclosure may be applied. The same or similar shape as the head circulation pump 230 described above may be applied to the circulation pump 330, and different structure and shape from the head circulation pump 230 may be applied thereto.

According to the present disclosure, the ink storage unit of the inkjet printer is configured to stir and move the ink stored therein to maintain the dispersibility in a process of circulating the ink stored in the ink storage unit, which supplies the ink to the inkjet head, to the outside and injecting the ink into the ink storage unit. The ink storage unit of the present disclosure is different from an ink storage unit in which ink is stirred by using a stirrer in an ink storage space thereof. In supplying the ink from the ink storage unit of the inkjet printer to the inkjet head, the conventional ink storage unit performs the supply of ink in one direction. Recently, a structure for circulating ink from the ink storage unit to the outside were developed, the structure of the ink storage unit being configured to recover remaining ink not discharged from the inkjet head to the ink storage unit again. A technique for maintaining the dispersibility of ink, the technique continuing an ink flow by a method of circulating the ink through the circulation line provided to supply and recover the ink with respect to the inkjet head, were also developed. However, a flow rate of the ink movable through the line connected to the inkjet head performing precise ink discharge is limited, so that there was a limit to maintaining the dispersibility of the ink. The ink storage unit of the present disclosure includes a separate exterior circulation line in addition to the circulation line connected to the inkjet head, and is characterized to maintain the dispersibility of ink by performing ink stirring as the ink introduced into the ink storage space through the exterior circulation causes the movement of the ink in the ink storage space.

Furthermore, the ink storage unit of the present disclosure is configured to circulate the ink stored in the ink storage unit, so the present disclosure is different from a technique for performing ink circulation between a buffer ink storage unit provided for supplying ink to the ink storage unit and an exterior ink tank provided for supplying the ink to the buffer ink storage unit to maintain the dispersibility of ink additionally supplied to the ink storage unit. The structure for circulating the ink located between the ink storage unit and the external ink tank provided for supplying the ink from the outside to the ink storage unit may be to the present disclosure within a range not affecting the technical sprit of the present disclosure.

The ink storage space in the ink storage container 100 includes an outlet and an inlet. The outlet is connected to the circulation tube 310 to discharge ink and circulated ink is injected into the inlet again. The embodiment of the present disclosure is characterized to re-inject ink into the ink storage container 100 through the circulation tube 310 to move ink stored in the ink storage space so that stirring is caused inside the ink storage space, and the ink should be injected into the ink storage space with an adequate force to move and stir the ink stored in the ink storage space. The force to re-inject the ink may be adjusted through the circulation pump 330, and it is preferable that the outlet and the inlet are provided at locations where the force to re-inject the ink is strengthened. The locations of the outlet and the inlet will be described in detail later.

The circulation tube 310 of the present disclosure serves to circulate the ink stored in the ink storage unit and to re-inject the circulated ink. A degasser 340 is installed to the circulation tube 310, thus maintaining the quality of the ink.

The degasser 340 serves to remove micro bubbles contained in the ink and to remove gas resolved in the ink, such as dissolved oxygen, etc., to maintain the quality of the ink. The ink storage container 100 has an airtight structure for adjusting internal pressure, but the inside of the ink storage container 100 is not vacuum, so the ink is brought into contact with gas in the ink storage container 100. Furthermore, even when ink is stored in the buffer ink storage unit provided to store ink before the ink is injected into the ink storage container 100 or the external ink tank, the ink is brought into contact with the atmosphere. Gases contained in the atmosphere is dissolved in the ink in contact with the atmosphere, and substances, such as dissolved oxygen generated when oxygen contained in the atmosphere is dissolved in the ink, becomes a cause of lowering the quality of the ink. In particular, in ink containing quantum dot materials or nanorods, a problem such as oxidation occurs in quantum dot materials and semiconductor nanorods due to dissolved oxygen contained in the ink. As the degasser, devices used in semiconductor manufacturing equipment or secondary battery manufacturing equipment may be applied and be adjusted according to the characteristics of the ink used for inkjet printing.

Furthermore, ink droplets are ejected through nozzles of the inkjet head in the inkjet printer, so that air may be introduced between the ejected ink droplets through the nozzles and air may be introduced into ink in a process of supplying the ink. The air introduced into the ink for various reasons In addition to the above process may exist in a form of large bubbles, but most of the air may spread to the ink in a form of very small micro bubbles. Bubbles in the ink causes problems such as blockage of the nozzles. Large bubbles cause various problems, but are easily removed, while micro bubbles do not cause problems, but are difficult to be removed. The micro bubbles in the ink are small and do not cause a problem in the inkjet printer, but a problem occurs as many micro bubbles agglomerate and form large bubbles. Therefore, it is necessary to continuously remove the micro bubbles so that the micro bubbles do not accumulate and agglomerate. The degasser 340 of the present disclosure removes the dissolved gas and micro bubbles thus preventing a problem caused by the large bubbles generated by the micro bubbles agglomerating in the ink.

Additionally, a filter 342 may be installed to the ink storage unit. The filter 342 serves to remove the micro bubbles and/or impurities contained in the ink. As shown in the drawings, the ink storage unit may be configured to allow the ink to be moved through the filter to the degasser 340, and a location of the filter 342 is not limited thereto. The filter 342 and the degasser 340 may be separately installed and the filter 342 and the degasser 340 may be modularized by being grouped.

Since the filter 342 may remove the micro bubbles, the ink storage unit capable of stirring ink by ink circulation according to the embodiment of the present disclosure is configured to perform micro bubbles removal by both the degasser and the filter to be excellent in the micro bubble removal efficiency, whereby it is possible to prevent a problem caused by the bubbles contained in the ink.

The degasser and the filter can be composed of equipment that does not affect particles such as quantum dot materials or nanorods contained in the ink, and it is preferable that the ink flowing into the circulation tube 310 is circulated while particles of the ink is dispersed.

The ink replenishing tube 400 is connected to the ink storage container 100 to replenish ink gradually reduced by being discharged to the outside of the inkjet head 10 by the inkjet printing. The ink replenishing tube 400 is connected to the buffer ink storage unit temporarily storing ink in the middle of the ink replenishment to facilitate internal pressure control, and may supply the ink temporarily stored in the buffer ink storage unit to the ink storage container 100. The ink replenishing tube 400 is directly connected to the exterior storage tank storing ink outside the ink storage unit, and may supply the ink stored in the exterior storage tank to the ink storage container 100.

A location to which the ink replenishing tube 400 is connected is not particularly limited, but according to the embodiment, the ink replenishing tube 400 is connected to the bottom of the ink storage container 100 in order to perform stirring of ink by movement in the ink stored in the storage space, and this structure will be described in detail later.

According to the embodiment of the present disclosure, through the whole structure of the ink storage unit capable of stirring ink by ink circulation, it is described above as the ink storage unit includes the circulation line configured to circulate ink to the outside of the ink storage container 100 and to re-inject the circulated ink in addition to the circulation line toward the inkjet head 10, thereby generating movement in the ink in order to the ink stored in the ink storage container 100 in the airtight state may be self-stirred and maintain the dispersibility.

Hereinbelow, a structure in which a plurality of tubes connected to the ink storage container 100 and an effect in response to the structure will be described.

Figure 2:
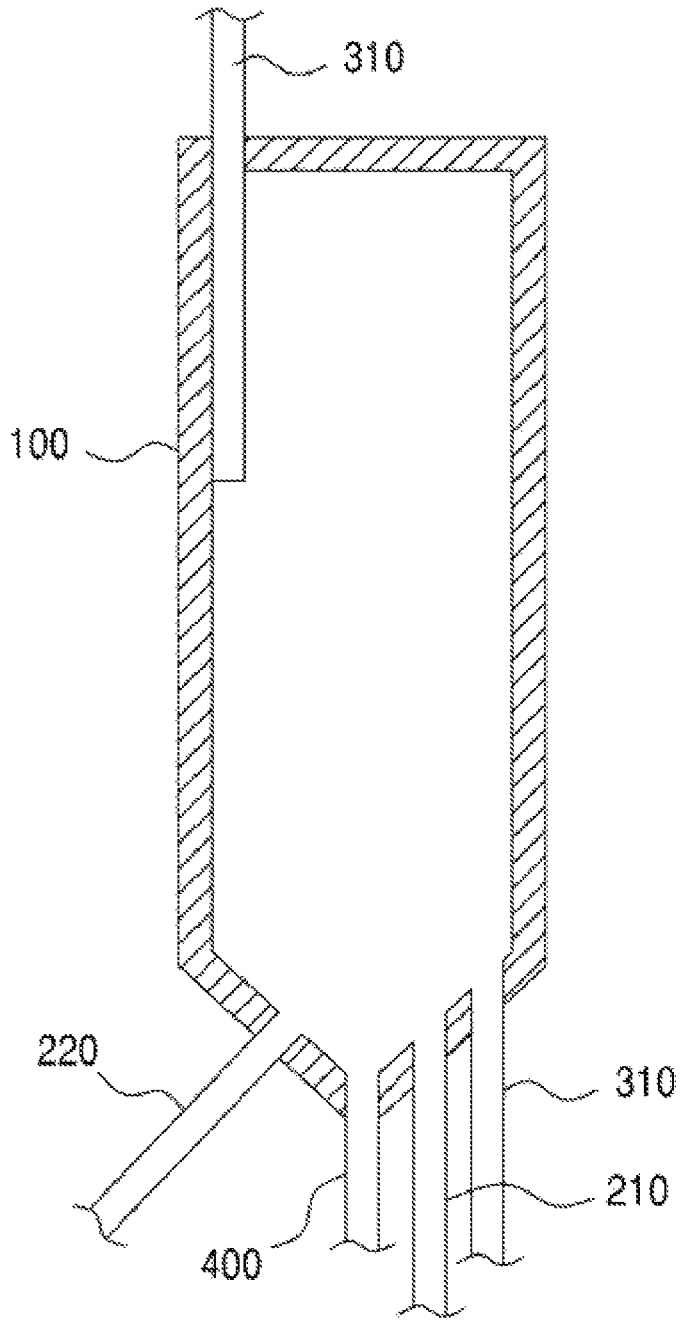
FIG. 2 is a schematic diagram showing a structure of an ink storage container used in the ink storage unit capable of stirring ink by ink circulation according to the first embodiment of the present disclosure.

FIG. 2 is a schematic diagram showing a structure of an ink storage container used in the ink storage unit capable of stirring ink by ink circulation according to the first embodiment of the present disclosure.

The ink storage container 100 used in the ink storage unit capable of stirring ink by ink circulation of the embodiment of the present disclosure is connected to the head supply tube 210, the head recovery tube 220, the circulation tube 310, and the ink replenishing tube 400. For the convenience of drawing description, it is simplified that the head supply tube 210, the head recovery tube 220, the circulation tube 310, and the ink replenishing tube 400 are located on the same level, but locations connected to the tubes may not be located on the same level.

According to the embodiment of the present disclosure, the ink storage container 100 has a cylindrical side wall and the bottom formed in an inverted conical shape or with an inverted conical inner surface, which are gradually deeper toward the center of the bottom surface. The above-described bottom structure prevents an ink stagnation area when the ink stored in the storage space is stirred, and settling of ink particles does not occur in the ink stagnation area. The head supply tube 210, the head recovery tube 220, and the ink replenishing tube 400 are connected to the bottom of the ink storage container 100, and the circulation tube 310 has a first end connected to the bottom of the ink storage container 100 and a second end penetrating an upper portion of the ink storage container 100 and inserted therein. The connected locations of the circulation tube 310 are not particularly limited and may be variable. The embodiment as shown in the drawings is selected to allow the stored ink to flow, and the structure will be described in detail later.

Figure 3:
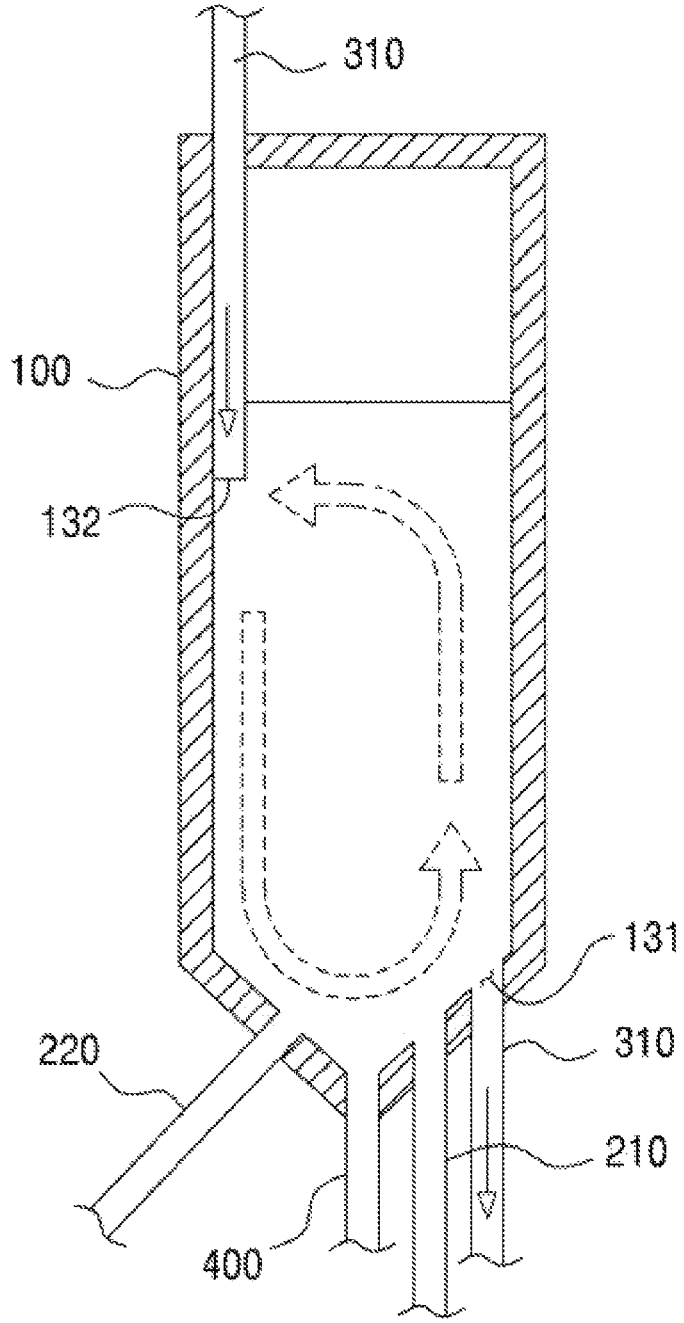
FIG. 3 is a view showing a principle of ink stirring operated by a circulation tube in the ink storage container used in the ink storage unit capable of stirring ink by ink circulation according to the first embodiment of the present disclosure.

FIG. 3 is a view showing a principle of ink stirring operated by a circulation tube in the ink storage container used in the ink storage unit capable of stirring ink by ink circulation according to the first embodiment of the present disclosure.

The opposite ends of the circulation tube 310 are respectively connected to the ink storage container 100. The ink storage container 100 includes the outlet 131 at a portion connected to the first end of the circulation tube 310 to drain the ink, and the inlet 132 at a portion connected to the second end of the circulation tube 310 into which the ink is re-injected.

The ink drained through the outlet 131 to the circulation tube 310 is re-injected through the inlet 132 into the ink storage container 100. The ink stored in the ink storage container 100 flows in the ink storage container 100 by a flow of the ink re-injected into the inlet 132, thus self-stirring of the ink is performed. In order to generate a flow of the stored ink to stir the stored ink by the re-injected ink, a force to inject the ink should be sufficient, and the force of the ink re-injected through the inlet 132 is obtained by the circulation pump 330 provided in the circulation tube 310. As described above, when the end of the circulation tube 310 with the inlet 132 penetrates and is inserted into the upper portion of the ink storage container 100, the force to inject the ink re-injected into the inlet 132 is strengthened while being added to gravity with the flow of the ink by the circulation pump 330. As shown in the drawings, when the end of the circulation tube 310 penetrates and is injected into the upper portion of the ink storage container 100, ink discharged from the inlet 132 generates a downward flow and then is changed into an upward flow rising after passing through the bottom. When the inlet 132 is located close to the side wall of the ink storage container 100, the downward flow is generated along a portion of the side wall close to the inlet and then the upward flow is generated through the bottom and along a portion of the side wall away from the inlet. According to the embodiment of the present disclosure, as the bottom of the ink storage container 100 is formed in the inverted conical shape, it is suitable for connecting the downward flow of the ink generated by the ink injected into the inlet 132 to the upward flow through the bottom.

Meanwhile, in the inlet 132 located while being spaced apart from the stored ink, there is a problem in that air is contained in the stored ink as the injected ink drips onto a surface of the stored ink. Therefore, the stored ink should be filled in the ink storage container 100 to a location higher than the inlet 132 so that the inlet 132 should be immersed in the stored ink. Furthermore, when the amount of the stored ink in the ink storage container 100 is too small, it is difficult to achieve self-stirring by the flow inside the stored ink. Therefore, it is preferable that a predetermined amount or more of the store ink is filled in the ink storage container 100, and an installation height of the inlet 132 is determined in consideration of the amount of the ink suitable for stirring and the capacity of the ink storage container 100.

As described above, the ink storage unit of the present disclosure is configured to induce stirring of ink by a flow of ink dripping through the inlet 132 located at the upper portion of the ink storage container 100, and in order to sufficiently perform stirring of ink, the upward flow of ink also needs to be strong enough. According to the embodiment of the present disclosure, in order to strengthen the upward flow for performing sufficient stirring of ink, a connection location of the head recovery tube 220 is provided at the bottom of the ink storage container 100.

Meanwhile, the outlet 131 may be connected to the lowest location at the bottom of the ink storage container 100. The ink storage unit of the present disclosure may be configured to increase the dispersibility improvement efficiency of particles by sufficiently stirring of ink by draining the ink at a location where the particles are settled.

Figure 4:
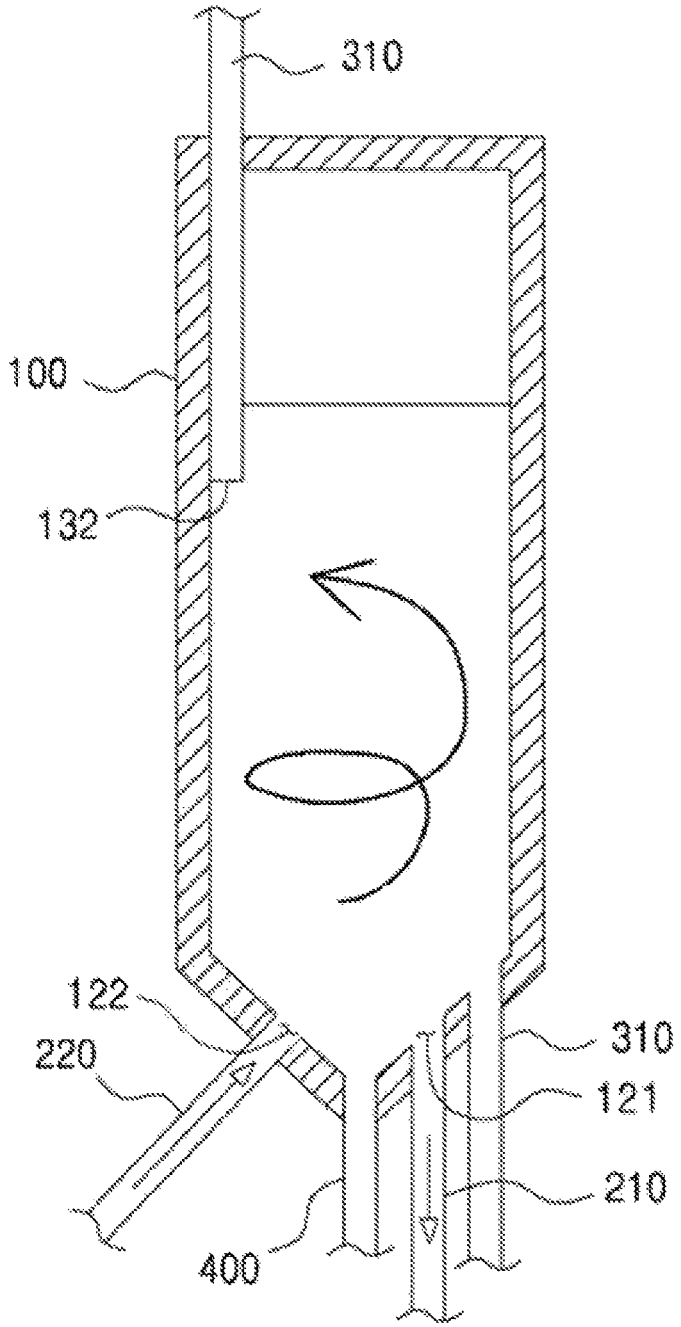
FIG. 4 is a view showing the principle of ink stirring operated by head circulation in the ink storage container used in the ink storage unit capable of stirring ink by ink circulation according to the first embodiment of the present disclosure.

FIG. 4 is a view showing the principle of ink stirring operated by head circulation in the ink storage container used in the ink storage unit capable of stirring ink by ink circulation according to the first embodiment of the present disclosure.

Figure 5:
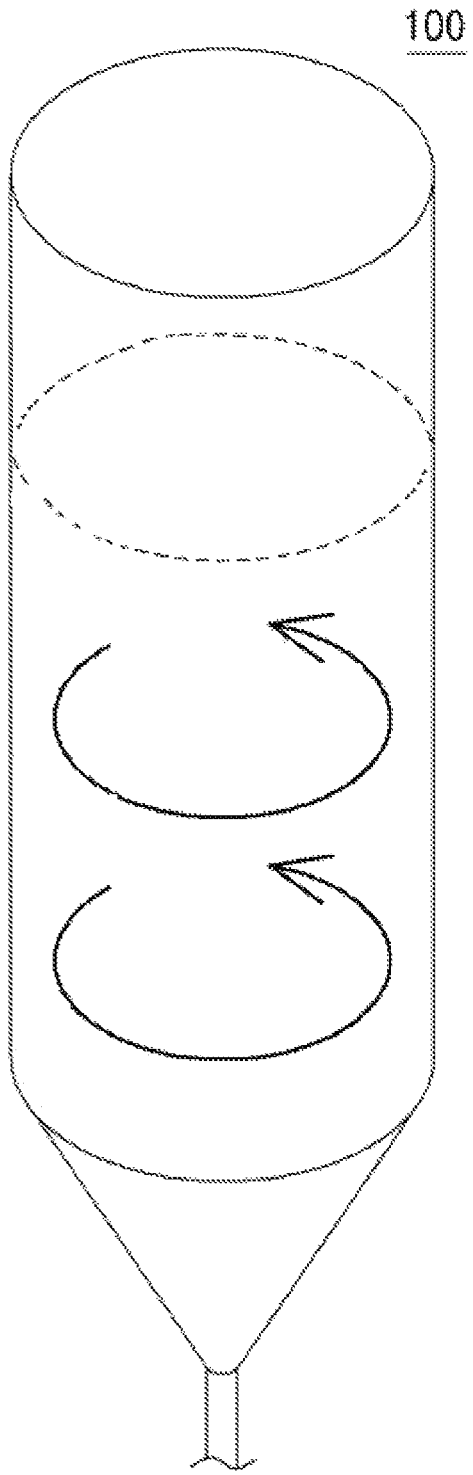
FIG. 5 is a view showing a flow of ink rotated along a cylindrical side wall in the ink storage container used in the ink storage unit capable of stirring ink by ink circulation according to the first embodiment of the present disclosure.

According to the embodiment of the present disclosure, both the head supply tube 210 supplying ink to the inkjet head and the head recovery tube 220 recovering the ink from the inkjet head are connected to the bottom of the ink storage container 100. A connected location of the head recovery tube 220 is not particularly limited, but as shown in the drawings, the head recovery tube 220 is connected to the bottom of the ink storage container 100 thus ink recovered through the bottom may generate an upward flow in the stored ink, and may strengthen the upward flow generated at an opposite side to the downward flow generated through the inlet 132 described above. As the bottom of the ink storage container 100 of the embodiment of the present disclosure is formed in an inverted conical shape, the head recovery tube 220 is connected to the ink storage container 100 at an inclined angle or a horizontal angle instead of in a vertical angle, so that the ink injected from the recovery port 122 is directed toward an inner surface of the inverted conical bottom, whereby a spiral flow rising along the inner surface may be generated. When an installation direction of the head recovery tube 220 is adjusted to generate a flow of ink rising in a spiral, a flow of the store ink rotating along the cylindrical side wall may be generated as shown in FIG. 5 in addition to the flow of the stored ink in a vertical direction. Therefore, the stirring efficiency of ink is improved and the dispersibility of ink is increased.

Preferably, the force of injecting the ink through the recovery port 122 and the force of injecting ink through the inlet 132 are selected within a range to increase the efficiency of stirring in the vertical direction and to generate a stirring flow rotating in the horizontal direction.

Figure 6:
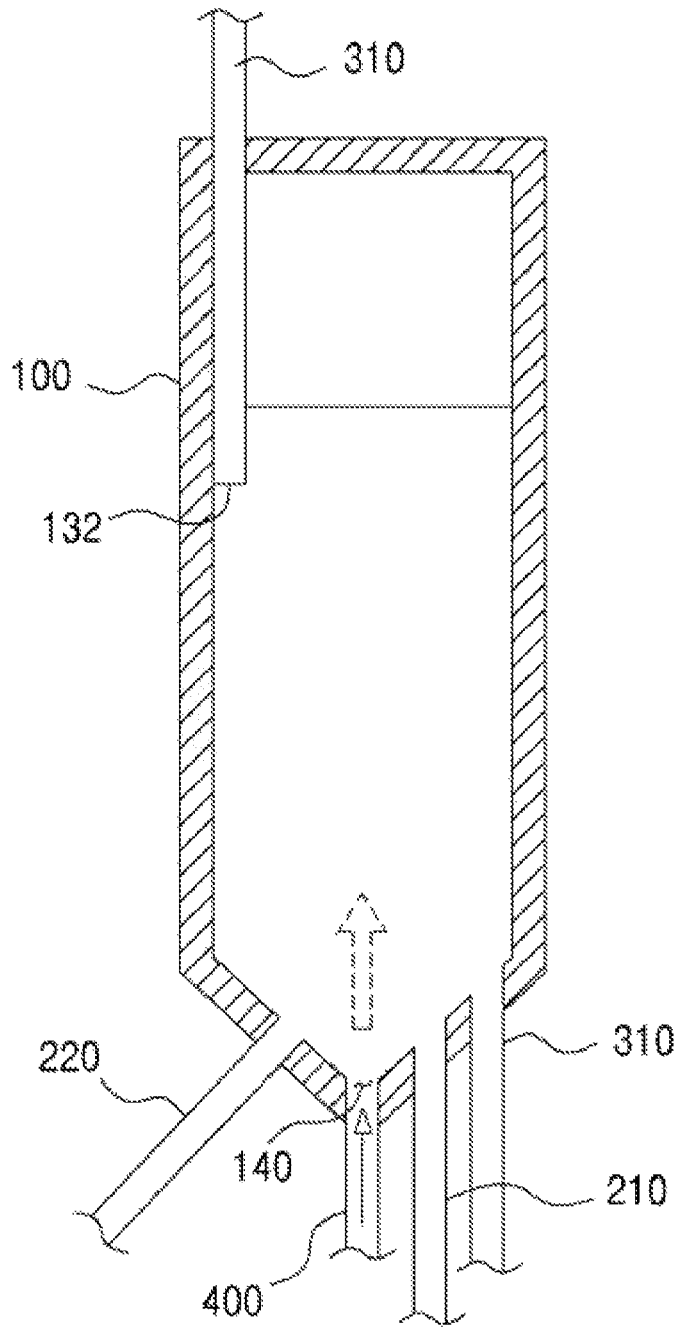
FIG. 6 is a view showing a principle of ink stirring performed through an ink replenishing tube in the ink storage container used in the ink storage unit capable of stirring ink by ink circulation according to the first embodiment of the present disclosure.

FIG. 6 is a view showing a principle of ink stirring performed through an ink replenishing tube in the ink storage container used in the ink storage unit capable of stirring ink by ink circulation according to the first embodiment of the present disclosure.

According to the embodiment of the present disclosure, the ink replenishing tube 400 for replenishing ink gradually reduced by being discharged to the outside of the inkjet head 10 is connected to the bottom of the ink storage container 100. In the conventional inkjet printer, it is rare to connect the ink replenishing tube 400 replenishing ink to the ink storage unit to the bottom of the ink storage container 100. However, according to the present disclosure, the ink replenishing tube 400 is connected to the bottom of the ink storage container 100 so as to generate an upward flow of the ink added through the replenishing port 140. The upward flow of the ink added through the replenishing port 140 strengths the upward flow in the flow in which the ink stored in the ink storage container 100 is stirred in the vertical direction. In the embodiment of the present disclosure, it is shown that the ink replenishing tube 400 is connected to the lowest portion of the bottom of the ink storage container, but the location of the ink replenishing tube 400 is not limited thereto, and the ink replenishing tube 400 may be provided at other locations where the upward flow of the ink additionally supplied through the replenishing port 140 may be generated. Moreover, as shown in FIG. 5, ink replenishing tube 400 may be configured to inject ink toward the bottom as the head recovery tube 220 to generate a spiral upward flow of ink.

As described above, the ink storage unit of the present disclosure has effects of generating and strengthening a flow of stirring ink through the flow of the ink re-injected in a downward direction through the inlet 132 of the circulation tube 310, the flow of the ink recovered through the recovery port 122 of the head recovery tube 220, and the flow of the ink replenished through the replenishing port 140 of the ink replenishing tube 400. The flow through the inlet 132, the flow through the recovery port 122, and the flow through the replenishing port 140 are not always performed simultaneously, a single flow may be individually performed, or at least two flows or all the three flows may be performed simultaneously. Moreover, with sufficient dispersibility of ink, injection of ink through the inlet 132, the recovery port 122, and the replenishing port 140 may not be performed.

Meanwhile, as not shown in the drawings, a partition wall having a through hole may be provided inside the ink storage container 100. The partition wall may serve to prevent an excessive movement from being generated on an ink surface and to remove micro bubbles contained in the ink. The through hole provided in the partition wall does not affect the vertical flow and the horizontal flow for performing the stirring described above. An installation shape and the number of installation of the partition wall are variously selected. The partition wall may be installed while being vertically stood and a single partition wall may be installed or a plurality of partition walls may be installed crosswise. A shape of the through hole may be formed in a circular shape or a vertically or horizontally long slit shape. Moreover, the partition wall in a form of a net or mesh may be used.

Figure 7:
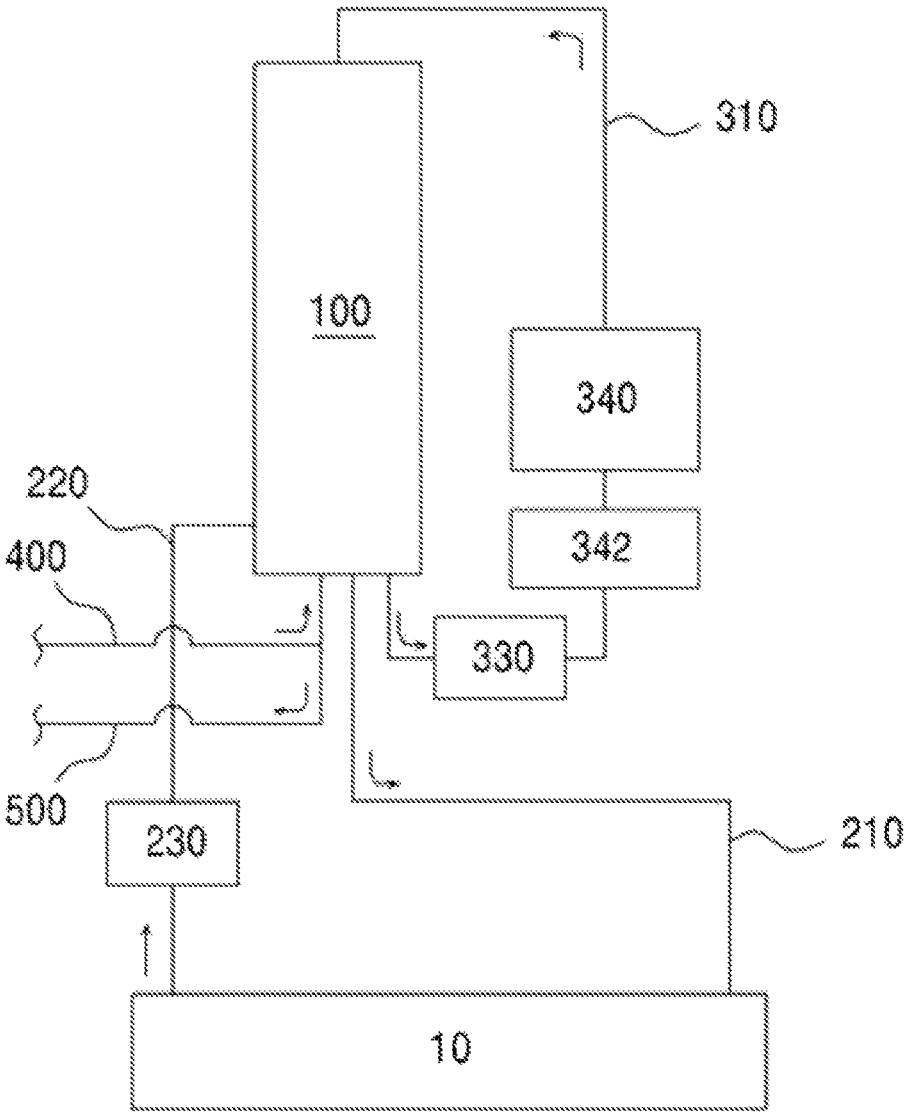
FIG. 7 is a schematic view showing a structure of an ink storage unit capable of stirring ink by ink circulation according to a second embodiment of the present disclosure.

FIG. 7 is a schematic view showing a structure of an ink storage unit capable of stirring ink by ink circulation according to a second embodiment of the present disclosure.

In the second embodiment of the present disclosure, the ink storage unit of the inkjet printer has the same structure as the first embodiment shown in FIG. 1 in the aspect including the ink storage container 100, the head supply tube 210, the head recovery tube 220, the head circulation pump 230, the circulation tube 310, the circulation pump 330, and the ink replenishing tube 400. The ink storage unit of the second embodiment of the present disclosure has a different structure from the first embodiment of the present disclosure in that a drain tube 500 is added thereto. Except for adding the drain tube 500, the configuration as described in FIGS. 1 to 6 may be applied to the third embodiment, so remaining components will be omitted.

The drain tube 500 is a tube draining ink to the outside when the ink storage container 100 needs to be emptied due to maintenance or repair of the inkjet printer or ink replacement. A location connected to the drain tube 500 is not particularly limited, but connecting the drain tube 500 to the lowest location of the ink storage container 100 is advantageous when the ink in the ink storage container 100 needs to be completely emptied. The drain tube 500 is separately installed, and when the ink replenishing tube 400 is connected to the lowest location in the bottom of the ink storage container 100 as described in the first embodiment, the drain tube 500 is connected to the ink replenishing tube 400 and a valve may be used to selectively operate the drain tube 500.

Figure 8:
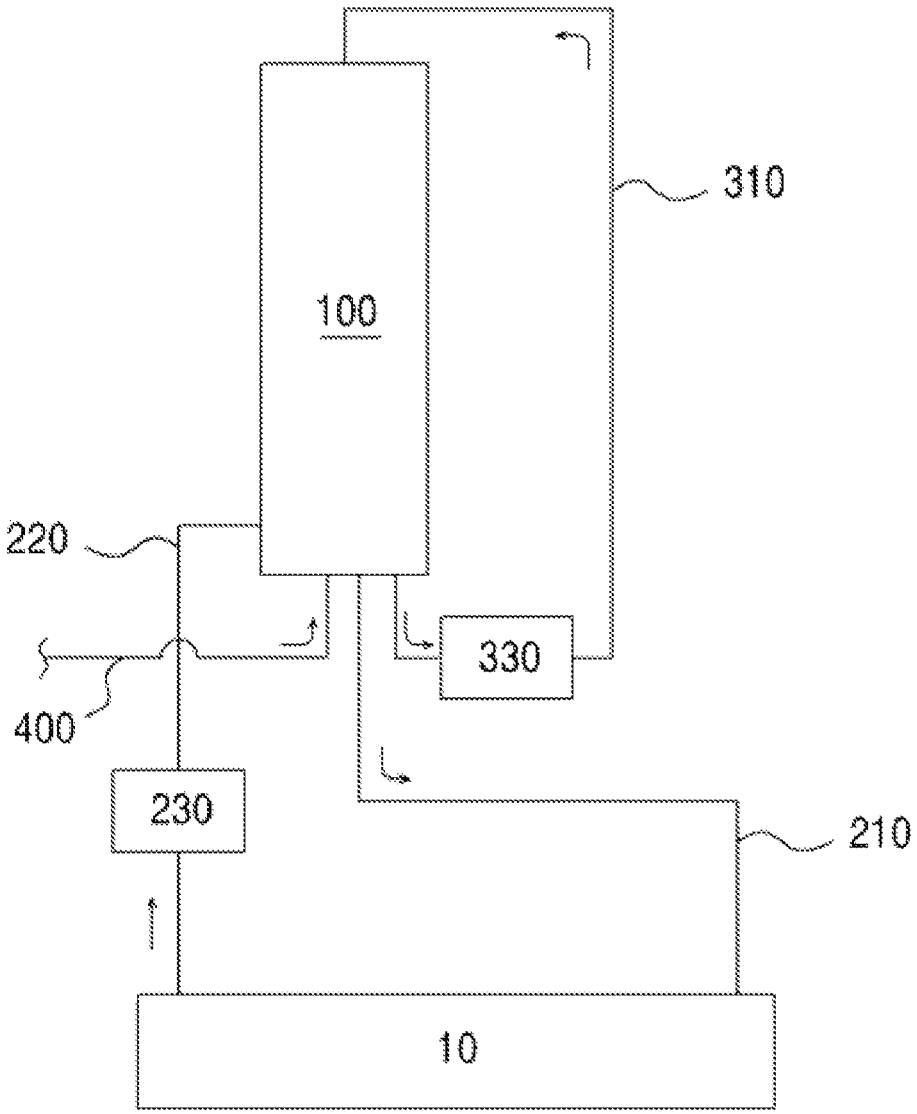
FIG. 8 is a schematic view showing a structure of the ink storage unit capable of stirring ink by ink circulation according to a third embodiment of the present disclosure.

FIG. 8 is a schematic view showing a structure of the ink storage unit capable of stirring ink by ink circulation according to a third embodiment of the present disclosure.

In the third embodiment of the present disclosure, the ink storage unit of the inkjet printer has the same structure as the first embodiment shown in FIG. 1 in the aspect including the ink storage container 100, the head supply tube 210, the head recovery tube 220, the head circulation pump 230, the circulation tube 310, the circulation pump 330, and the ink replenishing tube 400. The ink storage unit of the third embodiment of the present disclosure has a different structure from the first embodiment of the present disclosure in that the degasser is not used, and except for not using the degasser, the configuration as described in FIGS. 1 to 6 may be applied to the third embodiment, so remaining components will be omitted.

As described above, when the degasser or the filter is applied to the circulation tube 310, there is an advantage of maintaining the quality of ink. However, the circulation tube 310 in the present disclosure is provided to inject ink into the ink storage container to induce a flow of stored ink self-stirred. When it is difficult to inject the ink at a sufficient force to stir the ink due to a problem of the configuration such as the degasser, etc., the degasser may be omitted in the circulation tube 310. In order to maintain the quality of ink, the ink may be transferred to the degasser through a separate line.

Figure 9:
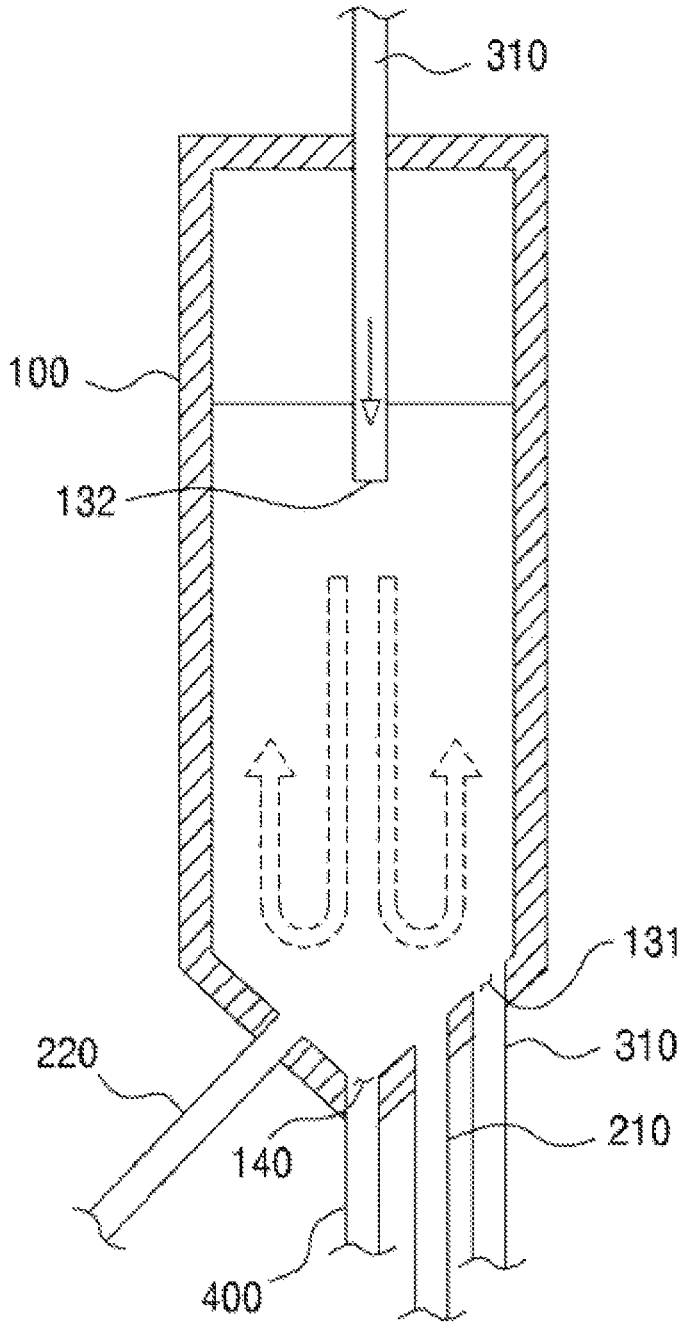
FIG. 9 is a view showing a principle of ink stirring performed through the circulation tube in the ink storage container used in the ink storage unit capable of stirring ink by ink circulation in according to a fourth embodiment of the present disclosure.

FIG. 9 is a view showing a principle of ink stirring performed through the circulation tube in the ink storage container used in the ink storage unit capable of stirring ink by ink circulation in according to a fourth embodiment of the present disclosure.

The fourth embodiment of the present disclosure has the same structure as the embodiment shown in FIGS. 2 to 6 in the aspect connecting the ink storage container 100 to the head supply tube 210, the head recovery tube 220, the circulation tube 310, and the ink replenishing tube 400. However, the ink storage unit of the fourth embodiment is different from the embodiment shown in FIGS. 2 to 6 in the aspect in that the end of the circulation tube 310 penetrating the upper portion of the ink storage container 100 and inserted therein is located at the center portion of the ink storage container 100, not at a location adjacent to the side wall.

As shown in the drawings, ink re-injected through the inlet 132 located at the center portion of the ink storage container 100 generates a downward flow moving downward along the center portion and the re-injected ink changes the downward direction at the bottom and generates an upward flow moving upward along the side wall, whereby a flow of stirring ink in the vertical direction may be generated. As described above, when a location generates a flow in the vertical direction, the location of the inlet 132 is not particularly limited and may be variously changed.

Although the preferred embodiments of the present disclosure have been disclosed for illustrative purposes, those skilled in the art will appreciate that various modifications, additions and substitutions are possible, without departing from the scope and spirit of the present disclosure as disclosed in the accompanying claims. It is thus well known to those skilled in that art that the present disclosure is not limited to the embodiment disclosed in the detailed description, and the patent right of the present disclosure should be defined by the scope and spirit of the invention as disclosed in the accompanying claims. Accordingly, it should be understood that the present disclosure includes various modifications, additions and substitutions without departing from the scope and spirit of the present disclosure as disclosed in the accompanying claims.

What is claimed is:

1. An ink storage unit capable of stirring ink by ink circulation, the ink storage unit being configured to store ink for supplying the ink to an inkjet head comprising a plurality of nozzles to discharge the ink, the ink storage unit comprising:

an ink storage container having an inside space configured to store the ink therein;

a head supply tube configured to supply the ink stored in the ink storage container to the inkjet head;

a head recovery tube configured to recover remaining ink remained in the inkjet head to the ink storage container;

a circulation tube configured to drain the ink through a first end thereof connected to the ink storage container and to receive the ink through a second end thereof connected to the ink storage container; and a circulation pump provided in the circulation tube to transfer the ink, wherein the ink stored in the ink storage container is stirred by a flow of the ink re-injected to the ink storage container through the circulation tube.

2. The ink storage unit of claim 1, wherein an inlet configured to re-inject the ink from the circulation tube to the ink storage container is located more than a predetermined height from a bottom of the ink storage container, and the ink stored in the ink storage container is stirred by a downward flow of ink generated by the ink injected from the inlet.

3. The ink storage unit of claim 1, wherein the ink storage container has a shape with a cylindrical side wall and an inverted conical bottom, the bottom of the ink storage container being concentrically narrowed in a downward direction.

4. The ink storage unit of claim 3, wherein the head recovery tube is connected to the bottom of the ink storage container, and the ink stored in the ink storage container is stirred by a flow of spiral rising ink generated as the ink injected through a recovery port located at an end of the head recovery tube is injected toward the bottom.

5. The ink storage unit of claim 3, wherein an ink replenishing tube is connected to the bottom of the ink storage container, and the ink stored in the ink storage container is stirred by an upward flow of ink generated by the ink injected through a replenishing port located at an end of the ink replenishing tube.

6. The ink storage unit of claim 1, wherein a degasser is provided in the circulation tube to remove micro bubbles and gas dissolved in the ink.

7. The ink storage unit of claim 1, wherein a partition wall having a through hole is provided in the ink storage container.

8. The ink storage unit of claim 7, wherein the through hole is formed in a circular shape of or a vertically or horizontally long slit.

* * * * *